United States Patent [19]

Trammel

[11] Patent Number: 4,842,171

[45] Date of Patent: Jun. 27, 1989

[54] METERING CASTING LADLE

[75] Inventor: Gary L. Trammel, 5540 Walnut Ave., Long Beach, Calif. 90805

[73] Assignee: Gary L. Trammel, Long Beach, Calif.

[21] Appl. No.: 276,119

[22] Filed: Nov. 25, 1988

[51] Int. Cl.[4] ..... B22D 39/02

[52] U.S. Cl. ..... 222/595; 222/596; 222/629

[58] Field of Search ..... 222/595, 596, 629

[56] References Cited

U.S. PATENT DOCUMENTS

| | | | |
|---|---|---|---|
| 3,608,621 | 9/1971 | Bollig et al. | 222/595 |
| 3,876,191 | 4/1975 | Lauersdorf | 222/595 |
| 4,340,160 | 7/1982 | van Geel et al. | 222/595 |

FOREIGN PATENT DOCUMENTS

| | | | |
|---|---|---|---|
| 727326 | 4/1980 | U.S.S.R. | 222/595 |

*Primary Examiner*—Robert McDowell

[57] ABSTRACT

A small, simple tool used to meter precise volumes of molten metal. It has been effectively utilized by the bullet caster to make expandable projectiles for hunting. This is accomplished by using the tool to meter a small volume of molten soft lead alloy into a bullet mould, the completing the cast with a molten lead alloy of higher strength. This creates a dual-alloy bullet with the structural strength necessary for high velocity shooting, but having a nose soft enough to effectively expand upon impact with a target.

The tool consists of a long, hollow barrel with a short drop tube installed in one end. The drop tube is mounted in the nozzle end of the barrel and projects into its hollow interior. The vacant space inside the barrel adjacent to the drop tube forms a reservoir to hold molten metal. When the barrel unit is submerged into a pot of molten metal, the alloy enters the nozzle and flows up the drop tube, thereby filling the interior of the barrel. When the barrel unit is withdrawn from the pot of molten metal, a finite quantity of molten metal is held in the barrel's reservoir, the remainder draining through the internal drop tube and out of the nozzle.

To meter a volume of molten metal to a mould, a mechanical displacer is inserted into the full reservoir to a pre-set depth. This causes a quantity of molten metal to be displaced, overflowing it into the drop tube, out of the nozzle and into the mould.

3 Claims, 2 Drawing Sheets

METERING CASTING LADLE

BACKGROUND OF THE INVENTION

Figure 1:
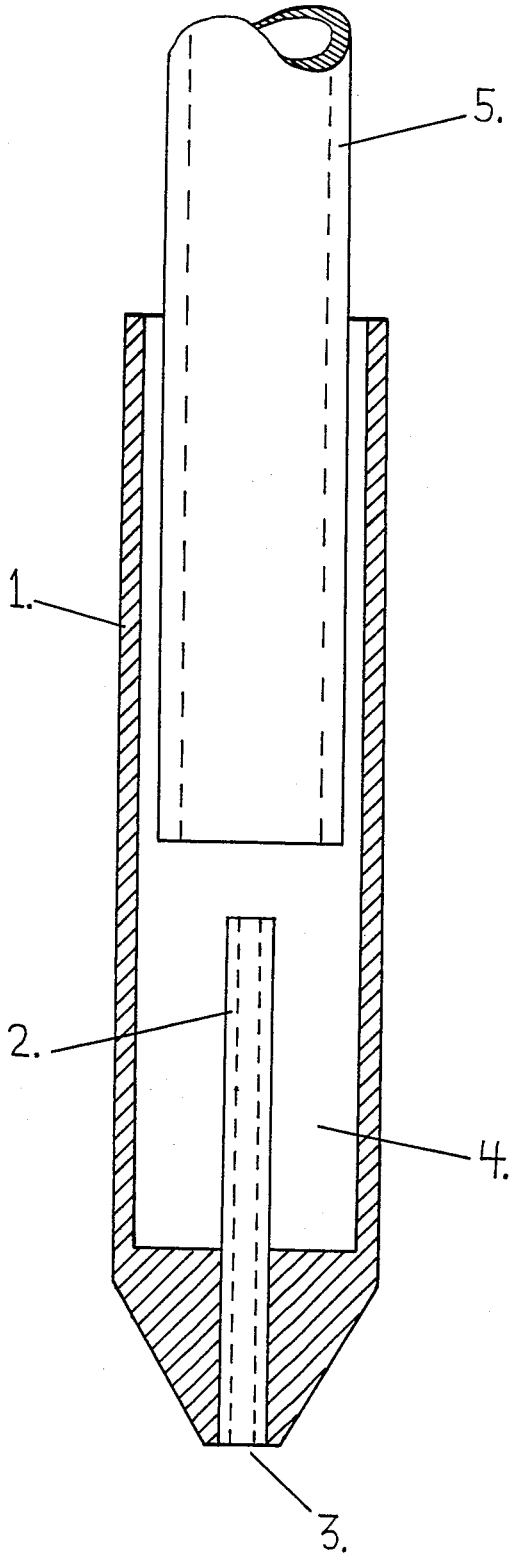

A. Field of the Invention:

The METERING CASTING LADLE was originally designed for, and has been utilized to good advantage in the field of bullet casting. Lead alloy bullets produced by casting are extensively used as projectiles for handgun and rifle shooting. Although not suitable for every shooting need, cast lead alloy bullets are economical, perform well in some applications and can be easily crafted by the hobbyist at home.

Standard bullet casting equipment consists of a bullet mould and a lead melting pot (usually gas or electric). The molten lead alloy is dispensed into the bullet mould by the melting pot's pouring spout or by a separate ladle to produce a solid, monometallic casting.

Selecting a lead casting alloy with mechanical properties suitable to the intended shooting task sometimes leads to a dilemma. If bullet expansion upon impact with the target is desirable, as it would be for many hunting situations, a softer lead alloy would be preferred. But soft lead alloy bullets generally exhibit poor functional performance: lead fouling in the gun barrel and erratic shooting accuracy. The stresses produced in attaining a velocity high enough to cause a lead alloy projectile of a given hardness to effectively expand upon impact will generally exceed the functional strength level of that lead alloy. Increasing bullet hardness allows higher effective shooting velocity, but further inhibits terminal expansion. A softer bullet would expand easier, but cannot be efficiently driven fast enough to ensure its own expansion. Shooting unjacketed (bare lead) cast bullets has always been a compromising situation when an expanding projectile would be advantageous, until now.

The METERING CASTING LADLE is designed to accurately dispense a calibrated volume of clean molten metal from its melter to a mould. A quantity of soft lead alloy can be injected into the nose portion of a bullet mould cavity with the METERING CASTING LADLE (not completely filling the cavity), and the remainder of the cavity filled with a hard lead alloy by conventional means. The two lead alloys thoroughly fuse at their junction to produce a one-piece cast bullet with a soft, expandable nose, and a hard, strong body to withstand the stresses of high velocity shooting.

B. Description of Prior Art:

Producing dual-alloy castings has always been hindered by the lack of a practical means to accurately meter the desired quantity of the first metal alloy to go into the mould. When using a common casting ladle, there is no way to precisely control the volume of metal being poured. Furthermore, the presence of oxides and other impurities on the surface of a molten metal, along with the elevated temperatures involved, render common methods of dispensing accurate volumes of cold fluids unsatisfactory.

Strong-bodied expanding bullets have been made by casting two separate pieces (a soft nose section and a hard body section), then joining them by mechanical or adhesive means. In most cases where an expanding projectile is deemed necessary, the practical shooter would choose a copper or gilding metal jacketed soft-nose or hollow-point bullet. The soft-nose, dual-alloy cast bullet produced with the METERING CASTING LADLE is an economical and effective alternative to costly jacketed bullets for many shooting activities.

SUMMARY

The METERING CASTING LADLE is an easy-to-use tool that can be practically employed by the metal caster to make dual-alloy castings. It has proved to be excellent for crafting inexpensive expanding hunting bullets for handguns and rifles. A pre-determined amount of soft lead alloy is metered into a bullet mould with the METERING CASTING LADLE to partially fill the cavity. The pour is then completed with a hard lead alloy to make a solid, dual-alloy projectile with the necessary strength to permit clean, accurate high velocity shooting while exhibiting effective nose expansion upon target impact.

DRAWINGS

Figure 2:
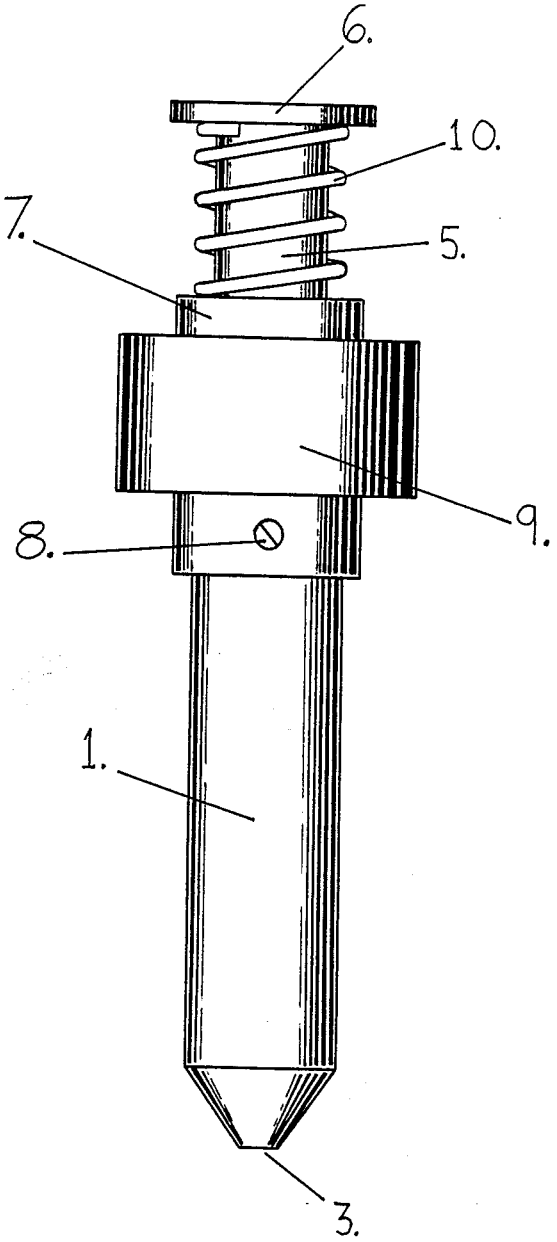

In the drawings, the METERING CASTING LADLE is shown larger than current working models for ease of viewing. FIG. 1 is a partially sectioned view of the fluid processing constituents of the unit, showing the barrel (1), drop tube (2), nozzle (3), reservoir (4) and the displacer (5). Components not necessary to show the actual fluid metering functions of the unit have been excluded from FIG. 1 for simplicity. FIG. 2 is an external view of the METERING CASTING LADLE, showing the barrel (1), nozzle (3), displacer (5), flange (6), sleeve (7), set screw (8), insulating handle (9) and coil spring (10).

DESCRIPTION

The METERING CASTING LADLE is a unique metal casting tool that began development in my shop in early 1984. It has undergone numerous design changes in the process of evolving into the efficient unit shown in this specification. Its function is to draw molten metal from the crucible of a melter, and repeatedly meter precise, pre-determined quantities of that molten metal to a mould.

The main part of the tool consists of a hollow, tubular barrel (1) that is constricted to a smaller sized nozzle (3) orifice at one end. Permanently fixed in the nozzle (3) is a drop tube (2) that extends into the vacant interior space of the barrel (1) along the barrel's axis, and terminates within. The location of the unsupported, free end of the drop tube (2) dictates the fluid level of molten metal that can be held in the reservoir (4) of the barrel (1). The fluid volume of the reservoir (4) is determined by the length of the drop tube (2) and the internal capacity of the section of barrel (1) surrounding the drop tube (2).

The fluid actuating component of the METERING CASTING LADLE is the displacer (5). This movable part is initially positioned inside the barrel (1) above the drop tube (2). The displacer (5) could take several forms, but works exceptionally well in the form of a tubular member (shown here) that will enter the barrel (1) with generous clearance. Ample external clearance with the inside of the barrel (1), along with its open bore, give the tubular displacer (5) the necessary venting capabilities for efficient operation. The bore of the tubular displacer (5) also offers the necessary clearance to accommodate the drop tube (2) when the displacer (5) enters the reservoir (4) during operation of the unit.

In operation, the METERING CASTING LADLE is held in the vertical position, perpendicular to the surface of the molten metal in its container. The nozzle (3) end of the unit is immersed in molten metal deep enough to submerge the unsupported, free end of the drop tube (2). Molten metal enters the nozzle (3), flows up through the drop tube (2) and fills the reservoir (4) and interior space inside the barrel (1) corresponding to the surface level of the molten metal in its container. Generous venting through the open upper end of the barrel (1) allows efficient filling. Because the molten metal enters the unit through the small nozzle (3) orifice and fills mostly from beneath the surface of the molten metal in its pot, dross and other impurities floating on the melt are avoided. This feature ensures a high-purity charge of molten metal inside the barrel (1), and also promotes flow uniformity by keeping the tool cleaner.

When the METERING CASTING LADLE (still vertical) is withdrawn from the melting pot, excess molten metal inside of the barrel (1) will drain down through the drop tube (2) and out of the nozzle (3). The reservoir (4) will be filled with molten metal, level with the upper tip of the drop tube (2). The reservoir (4) holds a finite quantity of molten metal.

The molten metal held in the reservoir (4) can now be metered from the unit to a mould by activation of the displacer (5). Moving the tubular displacer (5) downward into the reservoir (4) below the tip of the drop tube (2) displaces a volume of molten metal equal to the volume of the immersed displacer (5). The drop tube (2) enters the bore of the tubular displacer (5) as displacement of molten metal takes place. The displaced molten metal rises above the tip of the drop tube (2), and flows down the bore of the drop tube (2) and out of the nozzle (3). The amount of dispensed metal is controlled by a mechanical stop that limits the downward travel of the displacer (5). When the displacer (5) is moved to its stop, a precise quantity of molten metal is metered through the nozzle (3). The displacer (5) is then retracted to its original position outside of the reservoir, thereby readying the tool for the next metering cycle.

The current working model of the METERING CASTING LADLE is a small hand-held unit with a maximum capacity of about 150 grains (weight) of soft lead. The main component is a steel barrel (1) with a steel drop tube (2) welded in place. A short steel sleeve (7) has been drilled, tapped and fitted with a set screw (8), then installed in a wooden handle (9). This assembly functions as a insulated holding device as well as a mechanical stop to control travel of the displacer (5). The insulated handle-sleeve (9,7) slips onto (over) the upper end of the barrel (1), and can be locked at any desired position on the barrel (1) by the set screw (8). The steel displacer (5) is tubular, and has a fixed flange (6) at its upper end. A stainless steel coil spring (10) is installed on (around) the displacer (5) and bears against the flange (6). When the displacer (5) is inserted into the unit's barrel (1), the coil spring (10) passes through the handle-sleeve (9,7) and rests on the upper end of the barrel (1). The coil spring (10) provides a cushion of yieldable linear resistance between the flange (6) and the end of the barrel (1). Spring tension holds the displacer (5) in the ready position above the ti of the drop tube (2). In operation, the displacer (5) is pressed downward, compressing the coil spring (10), until the flange (6) contacts the sleeve (7) to stop displacer (5) travel within the reservoir (4). Displacer (5) travel can be adjusted by repositioning the handle-sleeve (9,7) on the barrel (1). Releasing the downward pressure on the displacer (5) allows the coil spring (10) to retract the displacer (5) to its ready position outside of the reservoir (4). In the working model, the sleeve (7) serves as an adjustable stop to control the travel of the displacer (5), but any type of mechanical stop could be used to regulate the movement of the displacer (5). And means other than the described set screw (8) could be used to secure the tubular sleeve (7) at its desired location on the barrel (1).

The METERING CASTING LADLE dispenses precise shots of molten metal quickly and handily, making the production of good expanding bullets a routine casting task for the hobbyist. Not limited to casting only lead alloys, the design of the device described herein can be used for metering other molten metal alloys. This tool will be manufactured and marketed nationwide for the purpose of making dual-alloy bullets to benefit hunters, sport shooters and law enforcement officers. Other metal casting pursuits requiring accurate volume metering capability will also be well served.

I claim the following:

1. A tool for metering precise volumes of molten metal, comprising a tubular barrel with a nozzle on one end, a drop tube, a reservoir, a tubular displacer with a fixed flange at one end, a coil spring, a tubular sleeve with a threaded hole accommodating a set screw, and an insulating handle, said drop tube being fixed in said nozzle and projecting into and terminating within the hollow interior of said barrel to form said reservoir in the vacant space adjacent to and surrounding said drop tube, the length of said reservoir corresponding to the length of said drop tube, said coil spring being positioned onto said displacer to bear against said flange, said insulating handle being affixed onto said sleeve, said sleeve being positioned onto said barrel, said sleeve encircling said barrel and being slidable thereon, said set screw securing said sleeve at any desired location on said barrel, said displacer being inserted into and movable within said barrel, said coil spring bearing against the end of said barrel, the presence and tension of said coil spring between said flange and said barrel maintaining said displacer at a position outside of but close to said reservoir, this said tool then being held in a vertical attitude and in that way submerged into said molten metal to allow said molten metal to enter said nozzle and flow up through said drop tube to fill said reservoir and said hollow barrel to the surface level of said molten metal in its container, said tool then being withdrawn from said molten metal in said container to permit the quantity of said molten metal inside of said barrel above said drop tube to drain down through said drop tube and out of said nozzle, said reservoir retaining the quantity of said molten metal that is below the upper end of said drop tube, at which time said displacer can be pushed toward and into said reservoir, said coil spring being compressed between said flange and said barrel, the linear travel of said displacer being terminated when said flange contacts the upper end of said sleeve, the immersed volume of said displacer below the end of said drop tube causing an equal volume of said molten metal contained within said reservoir to rise and overflow through said drop tube and out of said nozzle, the location of said sleeve on said barrel being changeable, thereby providing means to regulate the immersion depth of said displacer into said reservoir for the purpose of controlling the amount of said molten metal that is displaced from said reservoir, said displacer being retracted from said reservoir by said coil spring when downward pressure on said displacer is released.

2. A tool for metering precise volumes of molten metal, comprising a hollow barrel with a nozzle, a drop tube, a reservoir and a movable displacer, said drop tube being fixed in said nozzle and projecting into and terminating within the hollow interior of said barrel to form said reservoir in the vacant space adjacent to and surrounding said drop tube, said displacer being tentatively located at a starting position outside of said reservoir, said tool then being submerged into said molten metal to allow said molten metal to enter said nozzle, flow up through said drop tube and fill said reservoir and said hollow barrel to the surface level of said molten metal in its container, said tool then being withdrawn from said molten metal in said container to allow all of said molten metal inside of said barrel above the upper end of said drop tube to drain through said drop tube and out of said nozzle, the liquid surface level of said molten metal contained within said reservoir being flush with the upper end of said drop tube, at which time said displacer can be moved to a position within said reservoir to displace a quantity of said molten metal contained therein, said molten metal that has been displaced being forced to rise and subsequently overflow into said drop tube and out of said nozzle, thereby completing the metering cycle.

3. A tool for metering precise volumes of molten metal, comprising a hollow barrel, a nozzle, a drop tube, a reservoir, a displacer that can be inserted into said reservoir, and means to regulate the insertion depth of said displacer into said reservoir, said drop tube being fixed in said nozzle and projecting into and terminating within the hollow interior of said barrel to form said reservoir in the vacant space adjacent to and surrounding said drop tube, this said tool being submerged into said molten metal to allow said molten metal to enter said nozzle, flow up through said drop tube and fill said reservoir and said hollow barrel to the surface level of said molten metal in its container, said tool then being withdrawn from said molten metal in said container to allow said molten metal inside of said barrel above the upper end of said drop tube to drain through said drop tube and out of said nozzle, said reservoir containing the volume of said molten metal that is below the upper end of said drop tube, at which time said displacer can be moved to a position within said reservoir to displace a quantity of said molten metal that is contained therein, said molten metal that has been displaced being forced to rise and overflow into said drop tube and out of said nozzle, said means to regulate the insertion depth of said displacer into said reservoir being utilized for the purpose of controlling the amount of said molten metal that is displaced from said reservoir and subsequently expelled from said nozzle.

* * * * *